US009193566B1

(12) United States Patent
Nieves et al.

(10) Patent No.: US 9,193,566 B1
(45) Date of Patent: Nov. 24, 2015

(54) ELEVATOR CEILING

(71) Applicant: ELECLIP INTERIOR SYSTEMS, LLC, Miami, FL (US)

(72) Inventors: Rolando M Nieves, Miami, FL (US); Bill K Swenson, Miami, FL (US); David F Estrada, Miami, FL (US); Alejandro Guerra, Miami, FL (US); Dariesky Linares, Miami, FL (US)

( * ) Notice: Subject to any disclaimer, the term of this patent is extended or adjusted under 35 U.S.C. 154(b) by 0 days.

(21) Appl. No.: 14/482,752

(22) Filed: Sep. 10, 2014

(51) Int. Cl.
*B66B 11/02* (2006.01)

(52) U.S. Cl.
CPC ..... *B66B 11/0226* (2013.01)

(58) Field of Classification Search
CPC .. B66B 11/0226; B66B 11/0246; B66B 5/005
USPC ..... 187/401, 276
See application file for complete search history.

(56) References Cited

U.S. PATENT DOCUMENTS

| | | | | | |
|---|---|---|---|---|---|
| 627,257 | A * | 6/1899 | Haines et al. | B66B 5/027 | 182/95 |
| 837,826 | A * | 12/1906 | Handlan | B66B 5/027 | 182/90 |
| 4,043,430 | A * | 8/1977 | Kraft | B66B 13/08 | 187/324 |
| 4,635,756 | A * | 1/1987 | Sherwood | B66B 11/0253 | 187/401 |
| 6,202,800 | B1 * | 3/2001 | Muller | B66B 11/0246 | 187/401 |
| 6,202,801 | B1 * | 3/2001 | Muller | B66B 11/0246 | 187/269 |
| 6,209,686 | B1 * | 4/2001 | Tomasetti | B66B 11/0206 | 187/401 |
| 6,419,052 | B1 * | 7/2002 | Muller | B66B 11/0246 | 187/414 |
| 6,691,833 | B1 * | 2/2004 | Elsener | B66B 11/0246 | 187/254 |
| 6,739,432 | B2 * | 5/2004 | Elsener | B66B 11/0246 | 187/317 |
| 6,880,678 | B1 * | 4/2005 | Schneider | B66B 11/0246 | 187/314 |
| 7,066,617 | B2 * | 6/2006 | Mandy | B66B 11/0233 | 362/147 |
| 7,337,880 | B2 * | 3/2008 | Sittler | B66B 11/0246 | 187/254 |
| 7,469,773 | B2 * | 12/2008 | Yoon | B66B 11/0226 | 187/313 |
| 7,556,126 | B2 * | 7/2009 | Wang | B66B 11/0226 | 187/263 |
| 8,292,031 | B2 * | 10/2012 | Penn | B66B 11/06 | 182/141 |
| 2001/0022253 | A1 * | 9/2001 | Reuter | B66B 5/005 | 187/254 |
| 2003/0015378 | A1 * | 1/2003 | Elsener | B66B 11/0246 | 187/336 |
| 2006/0076194 | A1 * | 4/2006 | Endo | B66B 11/0226 | 187/414 |
| 2006/0289244 | A1 * | 12/2006 | Sittler | B66B 11/0246 | 187/401 |
| 2010/0038183 | A1 * | 2/2010 | Henseler | B66B 11/0246 | 187/276 |
| 2010/0200339 | A1 * | 8/2010 | Henseler | B66B 11/0246 | 187/401 |

* cited by examiner

*Primary Examiner* — William A Rivera
*Assistant Examiner* — Michael Riegelman
(74) *Attorney, Agent, or Firm* — Christopher J. Van Dam, PA; Chris Van Dam

(57) ABSTRACT

A ceiling assembly for an elevator cab that includes, among other features, an improved emergency access panel. The access panel appears to be part of a monolithic ceiling panel. When unlocked, the access panel is permitted to drop along a series of slides and remains substantially horizontal. Tracks are provided in the frame of the ceiling assembly that permits the dropped access panel to easily slide away to give access to the interior of the elevator cab through the ceiling. Drops in each of the tracks help bias the access panel open when it is placed in a fully open position.

5 Claims, 3 Drawing Sheets

ELEVATOR CEILING

BACKGROUND OF THE INVENTION

1. Field of the Invention

The present invention relates to elevators, and more particularly, to ceilings and emergency access hatches in passenger elevator cabs.

2. Description of the Related Art

Several designs for elevator cab ceiling have been designed in the past. None of them, however, includes a modular system with an easy, smooth operating and safe emergency fireman's escape panel integrated into the ceiling.

Applicant believes that the closest prior art reference is found in the ceilings of many elevator cabs operating across the world. However, the prior art differs from the present invention because the means to access the interior of the cab from the roof in an emergency is bulky and often difficult to move. Further, the prior art ceiling access panels must be tilted at such an angle during their normal use in an emergency so as to prohibit many types of lighting fixtures or wasting interior cabin height with ceiling mechanicals.

Other patents describing the closest subject matter and other known design that have been in use for years, provide for a number of more or less complicated features that fail to solve the problem in an efficient and economical way. None of these teachings suggest the novel features of the present invention.

SUMMARY OF THE INVENTION

It is one of the main objects of the present invention to provide a safe elevator including an effective and easy to operate emergency ceiling panel integrated into the design.

It is another object of this invention to provide an elevator ceiling that uses a minimal volume of space to allow for maximum volume and ceiling height in an elevator cab.

It is still another object of the present invention to provide an elevator ceiling system that is readily adaptable and adjustable to retrofit a wide variety of elevator cabs.

It is yet another object of this invention to provide such a system and device that is inexpensive to manufacture and maintain while retaining its effectiveness.

Another object of the present invention is to provide a light weight ceiling so that is easier on the installer and easier on the user to open close and maintain.

Another object of the invention is to improve the ease of engaging and disengaging the locking mechanism so that external access is enhanced.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Elevators are often refurbished and remodeled during their service life to refresh and update their look. These replacement ceilings as well as original ceilings in new elevator cabs are generally required to include an emergency access panel. In American elevators the emergency access panel or door is operable primarily from above and outside of the cab to be convenient to first responders and fire department rescue personnel allowing access to trapped passengers.

Often the emergency access panel (sometimes also referred to as a door, panel, access or hatch) in prior art designs is infrequently used and is difficult to operate. Historical designs use articulating arms that essentially allow a portion of the ceiling of the elevator cab to fall down and swing or roll out of the way.

The inelegant prior art emergency access panels took up a significant amount of space in the ceiling of the cab which is at a premium in the defined constraints of the elevator cab.

An improvement was needed to increase the available interior space of the elevator cab. The present design and the variations thereto succeed at this goal as well as allowing for smoother movement that further results in a safer and mechanically superior access panel that can be retrofit into existing cabs equally as well as it can be incorporated into original, new equipment.

Figure 1:
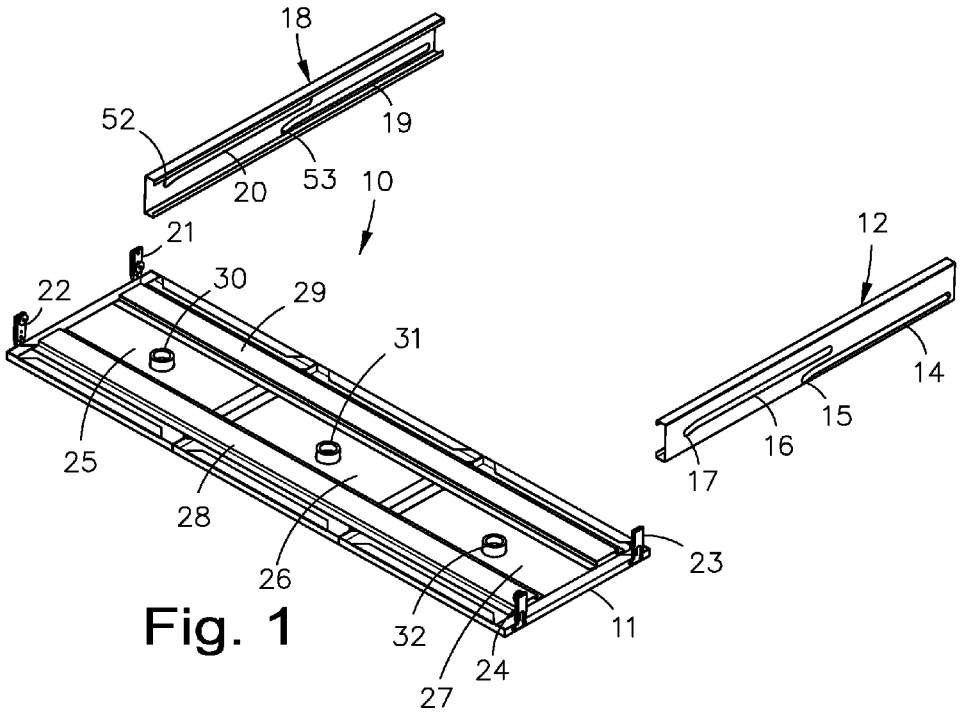
FIG. 1 represents a top side perspective view of a version of an elevator ceiling rolling moving section.

Referring now to the drawings, where the present invention is shown in several versions throughout the drawings and is generally referred to with numeral 10 in FIG. 1, where it can be observed that it basically includes, among other features, a drop panel 11, a rail assembly 12, a track 14, a drop 15, a track 16, a drop 17, a rail assembly 18, a track 19, a track 20, a slide 21, a slide 22, a slide 23, a slide 24, a panel 25, a panel 26, a panel 27, a brace 28, a brace 29, a light 30, a light 31, a light 32, a wheel 33, an axle 34, a slot 35, a sleeve 36, a flange 37, a bracket 38, a wheel 39, an axle 40, a slot 41, a sleeve 42, a flange 43, a bracket 44, a slot 45, a frame 46, a frame 47, a fixed panel 48, a light 49 and a lock 50.

Generally, an emergency drop panel 11 is shown in FIG. 1 with the rail assembly 12 and rail assembly 18. The drop panel 11 is shown assembled with other elements of a ceiling assembly in more detail in FIG. 2.

In this version of the device the drop panel 11 is comprised of panel 25, panel 26 and panel 27 connected side by side with the brace 28 along one edge and the brace 29 along the other edge. In this fashion the drop panel 11 is essentially a rigid and singular structure, meaning that these parts remain fixed relative to each other during normal operation of the elevator and ceiling.

Light 30 is optionally provided in panel 25, light 31 is optionally provided in panel 26 and light 32 is optionally present in panel 27. To ensure that the drop panel 11 has sufficient clearance under the fixed panel 48 during opening of the drop panel 11, the light 30, light 31 and light 32 should be low profile. In other words, the height of the light 30, light 31 and light 32 should not extend above the respective panel 25, panel 26 and panel 27 so that they would contact the underside of the fixed panel 48 when the drop panel 11 is lowered and slid underneath the fixed panel 48 when opening the ceiling.

Panel 25, panel 26 and panel 27 may be affixed to the brace 28 and brace 29 during initial fabrication remote from the site of the elevator cab into which it will be installed. Alternatively, for some applications it may be preferred that the manufacturer supply the panels 25-27 and braces 28 and 29 separate so that they can be fit on site by the installer to accommodate differing as-built conditions and ensure a tight, square fit with balanced reveals between the panels 25-27 and around the adjoining wall panels.

At each of the four corners of the drop panel 11 is a slide mechanism. As shown in FIG. 1, slide 22 and slide 21 are along the outside edge of panel 25. On the opposite side of the drop panel 11 is panel 27 that includes slide 23 and slide 24.

In at least one aesthetically pleasing and regulation compliant design, the drop panel 11 is approximately the same dimension, or a little smaller than, the fixed panel 48. This can vary widely depending on the application, size of the elevator cab and local regulations that dictate the dimensions of the fireman's access as generally defined by the size of the drop panel 11.

In a version of the design, flexibility of this system for use in addition to a doghouse or storage compartment is present while still allowing full functionality of an emergency ceiling panel. Some cabs have a doghouse attached to them that are used for moving crews to carry in long objects, like rolls of carpet, etc. The doghouse is generally not to be used from inside the cab to get out of the cab. The doghouse can also be used to maintain the lights or other mechanicals of the elevator.

Generally, the size of the drop panel 11 should be sufficient to allow the safe extraction of trapped elevator passengers in the case of an emergency. The first responder or fireman's requirements, including nature of the equipment they carry in a rescue situation should also be considered by the designer of the ceiling system that is fit into any elevator cab system.

It should be appreciated that the drop panel 11 can be located adjacent to or relative to the canopy exit or the drop ceiling exit. Any version of the system can be retrofit into any canopy without having to limit the exit. Of course, a custom designed new elevator can be easily adapted to employ the present device.

Figure 2:
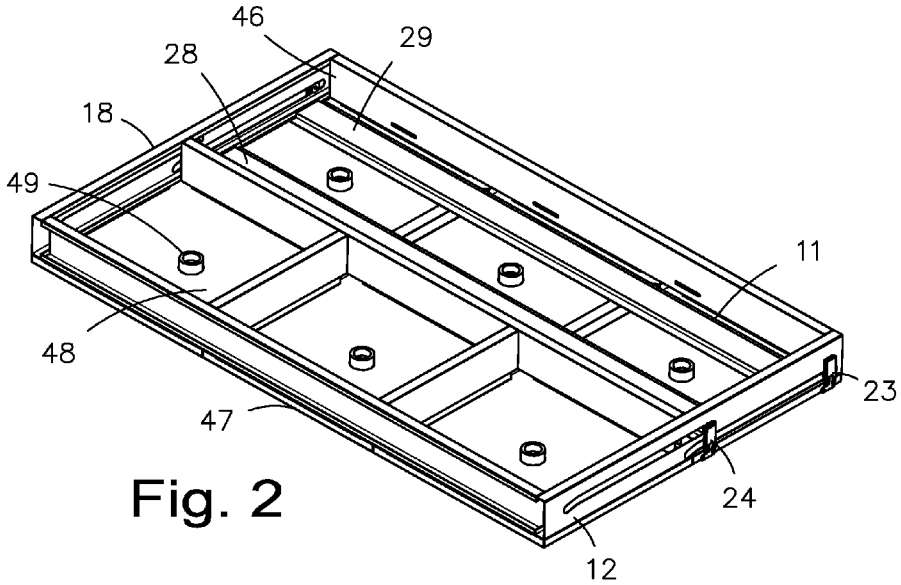
FIG. 2 shows a top side perspective view of a variety of a substantially complete ceiling assembly.

As seen in FIG. 2, the perimeter structure of the ceiling panel is formed by the frame 46 and frame 47 along the front and back of the ceiling panel along with the rail assembly 18 and rail assembly 12 on the left and right. Onto these frame members the fixed panel 48 is affixed. The drop panel 11 is moveable relative to the fixed panel 48, frame 47, frame 46, rail assembly 18 and rail assembly 12.

Generally, the drop panel 11 is moveably connected to the rail assembly 18 and rail assembly 12. In normal operation of the elevator onto which this ceiling assembly is attached, the drop panel 11 is locked against the frame 46 so that the drop panel 11 is substantially coplanar to the fixed panel 48. In this way in normal use of the elevator cab the riders do not see evidence that the drop panel 11 is moveable relative to the balance of the ceiling structure.

The fixed panel 48 is shown in the version of the device demonstrated in FIG. 2 to have three lights 49. One is called out but three are shown. These lights 49 are optional but are preferred by most owners of elevator cabs. Design considerations to limit the distance that the lights 49 below the fixed panel should be observed. Because the drop panel 11 will slide under the fixed panel during operation in an emergency the lights 49 should not be permitted to obstruct movement in the path of the drop panel 11.

Figure 3:
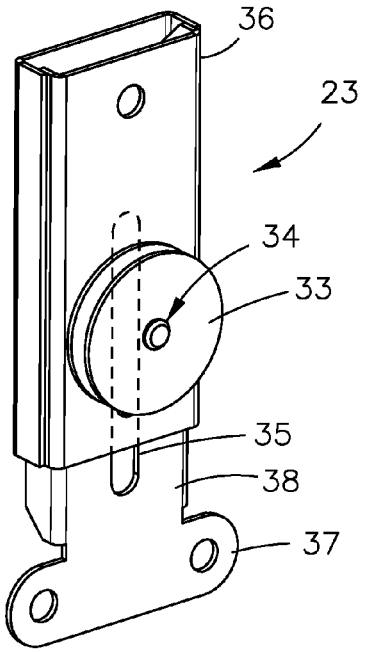
FIG. 3 illustrates a perspective view of an example of a first slide in an extended mode.
Figure 4:
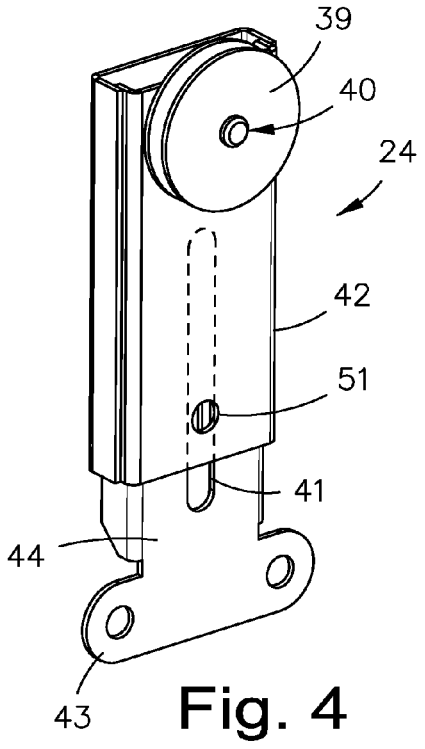
FIG. 4 is a perspective view representation of an example of a second slide in a retracted mode.

FIG. 3 and FIG. 4 show an example of a slide 23 and slide 24, respectively. As applied to the configuration of the version of the device shown in FIGS. 1 and 2, the slide 23 is materially similar in design to the slide 21 and the slide 24 is materially similar in design to the slide 22 as seen in FIG. 1.

Figure 5:
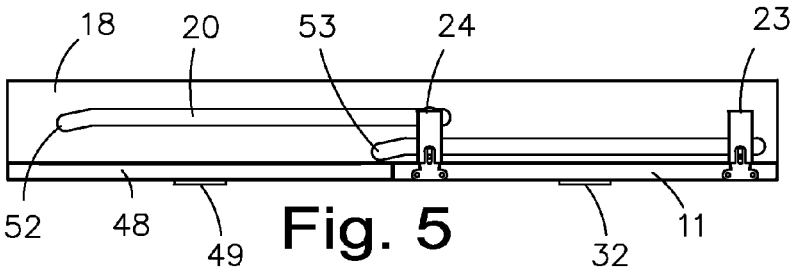
FIG. 5 represents a side elevation view of a version of a track assembly.
Figure 6:
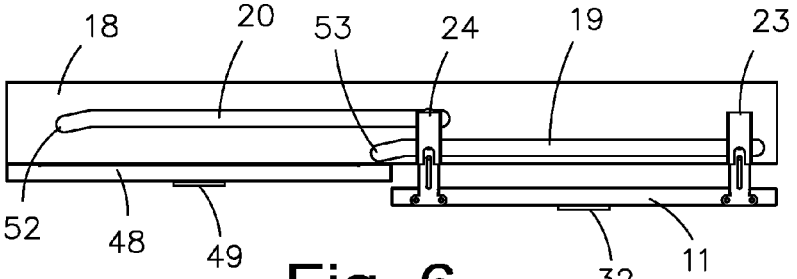
FIG. 6 demonstrates a side elevation view of an iteration of a track assembly.

The primary difference between the slide 23 (and by reference slide 21) and slide 24 (and by reference slide 22) is that slide 23 is configured for the lower track 14 on the rail assembly 12 where slide 24 is configured for the upper track 16 on the rail assembly 12. To maintain a generally horizontal drop panel 11 during while in an open mode and a closed mode the wheel 33 in slide 23 is offset from the wheel 39 in slide 23 a distance roughly equal to the difference between the track 20 and the track 19 as seen in FIGS. 5 and 6.

The wheel 33 is affixed to the sleeve 36 at the axle 34. The axle 34 permits rotational movement of the wheel 33 when the wheel 33 is moved in the track 19 so that the slide 23 assembly can fluidly move along the length of the track 19. The flange 37 is affixed to the edge of the drop panel 11.

The wheel 39 is affixed to the sleeve 42 at the axle 40. The axle 40 permits rotational movement of the wheel 39 when the wheel 39 is moved in the track 20 so that the slide 24 assembly can fluidly move along the length of the track 20.

Slide 23 and slide 24, similarly to the corresponding slides on the opposite edge of the drop panel 11, extend and retract longitudinally along the slot 35 and slot 41. The sleeve 36 is dimensioned to fit over the bracket 38 and keep in line during the longitudinal movement. The sleeve 36 slides along the bracket 38. The slot 35 in the bracket 38 is provided to limit the range of travel of the sleeve 36 relative to the bracket 38. Generally, the length of the slot 35 is similar to the overall longitudinal range of travel of the slide 23

The sleeve 42 is likewise dimensioned to fit over the bracket 44 and keep in line during the longitudinal movement. The sleeve 42 slides along the bracket 44. The slot 41 in the bracket 44 is provided to limit the range of travel of the sleeve 42 relative to the bracket 44. Generally, the length of the slot 41 is similar to the overall longitudinal range of travel of the slide 24. A tab 51 is optionally provided on the inside surface of the sleeve 42 and rides within the slot 41 to provide a positive limit of the upper and lower range of travel of the bracket 44. A similar tab may be included in any of the several slide designs.

Figure 7:
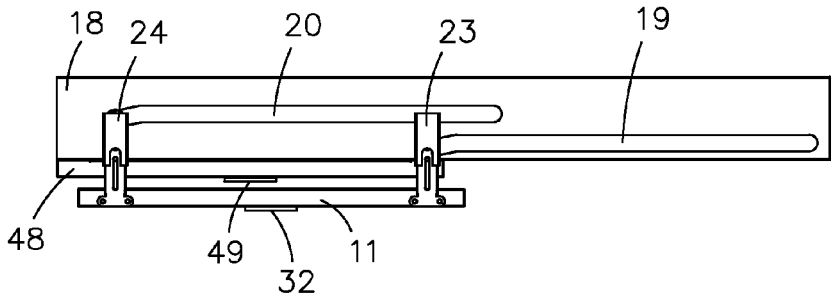
FIG. 7 shows a side elevation view of another variant of a track assembly.

Looking at FIGS. 5, 6 and 7, three sequential positions of the drop panel 11 are shown. FIG. 5 demonstrates the normal operating position of the ceiling assembly with the drop panel 11 affixed in the rail assembly 18 so that the drop panel 11 is substantially coplanar with the fixed panel 48. Wheel 39 rides in track 20 and wheel 33 rides in track 19. It is in this position that the lock 50 is engaged in the slots 45 (seen in FIG. 8) to lock and prevent movement of the drop panel 11 relative to the rail assembly 18 and fixed panel 48. While in this normal operating mode the ceiling appears to be a single unified panel to any occupants of the elevator cab.

When the drop panel 11 is to be opened, for example in an emergency to extricate trapped passengers from the elevator cab, the lock 50 is disengaged from the slots 45. After disengaging, the drop panel 11 must be unhinged by pulling up and pushing out the drop panel 11. This allows the drop panel 11 to drop when all four slides can extend simultaneously. The dropped, but not yet open, panel 11 is shown in an intermediate mode in FIG. 6. Generally, the slides 23 and 24 extend sufficiently to allow the drop panel 11 and light 32 to clear underneath the fixed panel and integral light 49 when the drop panel 11 is in an open mode.

FIG. 7 shows the drop down panel 11 in an open mode where the interior of the elevator can be accessed from on top of the elevator cab and occupants can exit. The wheel 39 of the slide 24 falls by gravity into the drop 52 at the same time the wheel 33 of the slide 23 falls by gravity into the drop 53.

The drops 52 and 53 are essentially dips in the end of the tracks 20 and 19, respectively, which provide a means to bias the drop panel 11 in the open position when the drop panel 11 is fully opened. The drops 52 and 53 are spaced on the rail assembly 18 at substantially the same distance apart as the slides 23 and 24 so that both slides encounter the drop at the same time when the drop panel 11 is fully opened. Drops 15 and 17 are similar in form and function to drops 52 and 53.

In a version of the slide 23 or 24, the brackets 38 and 44 move relative to the sleeves 36 and 42 with the aid of a series of intervening ball bearings. This can provide for a smooth and precise movement of the slide assemblies. Alternatively, a low friction material can provide a smooth and durable wear surface to improve the performance of the slide assemblies' retraction and extension movements.

Figure 8:
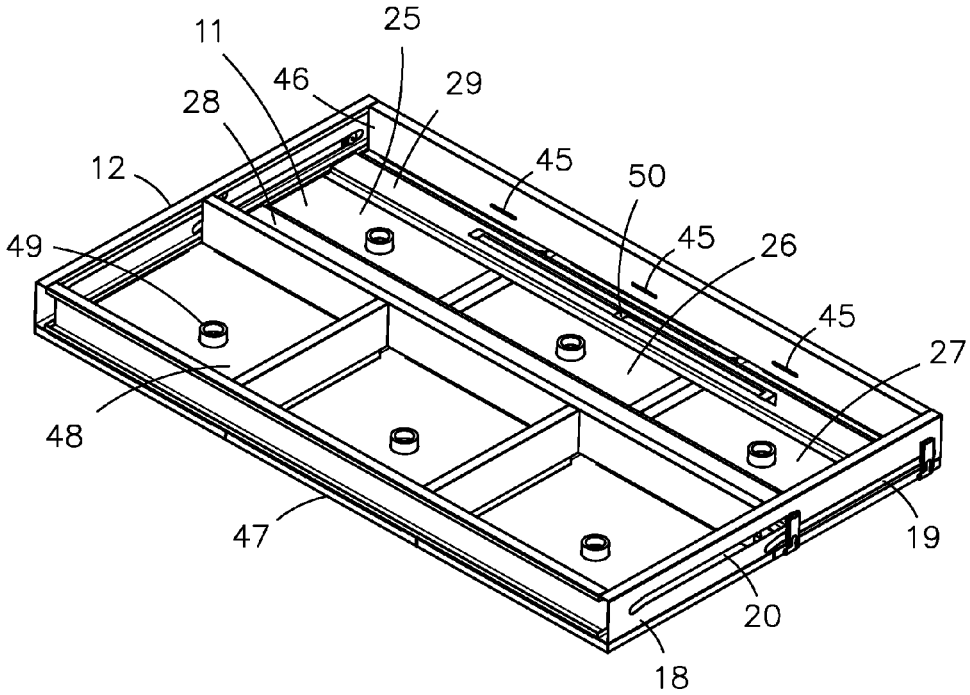
FIG. 8 is a perspective view of a top side of an embodiment of a ceiling assembly.

FIG. 8 shows a version of the ceiling from a top side where the several assemblies and sub-assemblies are shown to also include a lock 50 that is slideably attached to the top side of the drop panel 11. There are slots 45 on the frame 46 that correspond to tabs on the lock 50. The lock 50 can be manipulated from the top of the cab to engage or disengage the tabs from the slots 45 to free the drop panel 11 form the frame 46 so that the drop panel 11 can be opened or locked close.

In at least one version of the ceiling device the lock 50 is accessible from the interior of the elevator cab so that maintenance can be performed. When the lock 50 is accessible from the interior of the cab it is preferable to hide or disguise it in such a way as to deter improper opening of the drop panel 11.

A version of the elevator ceiling can be fairly described as being an elevator ceiling attached to an upper side of an elevator cab comprised of a drop panel, a fixed panel and a frame assembly. The frame assembly defines a perimeter of an elevator ceiling. The frame assembly includes a first rail assembly along a first segment of the perimeter that is substantially parallel to a second rail assembly along a second segment of the perimeter. The fixed panel is affixed at a first edge to the first rail assembly and at a second edge to the second rail assembly. The first rail assembly includes a first track along the length of the first rail assembly. The second rail assembly includes a second track along the length of the second assembly. The first track and second track are substantially the same length. The drop panel has a first end of a first slide on a first edge and a first end of a second slide on a second edge. A second end of the first slide is engaged in the first track and a second end of the second slide is engaged in the second track. When in a closed mode the drop panel is adjacent to and coplanar to the fixed panel. When in the closed mode a lock connects the drop panel to the frame assembly such that the drop panel and fixed panel are substantially coplanar. When the lock disengages the drop panel from the frame assembly the first slide and second slide are allowed to extend vertically thereby lowering the drop panel a predetermined distance into a lowered mode. When in a lowered mode the second end of the first slide moves in the first track and the second end of the second slide moves in the second track thereby transitioning the drop panel into an open mode. When the drop panel is fully in the open mode the first slide and second slide are biased to hold the drop panel in the open mode.

Some versions of the elevator ceiling can further include the first rail assembly having a third track parallel to the first track and the second rail assembly includes a fourth track parallel to the second track. A third slider connects the third track to an edge of the drop panel. A fourth slider connects the fourth track to an edge of the drop panel. It can also optionally have an end of the first track that has a drop that the second end of the first slide falls into to bias the drop panel in an open mode. Another option can be that both the first slider and the second slider extend to an equal predetermined distance that maintains the drop pane substantially horizontally when the drop panel is in an open mode. Another option can be that in the closed mode the elevator ceiling has a surface area substantially similar to a surface area of an upper side of an elevator cab.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An elevator ceiling attached to an upper side of an elevator cab comprised of a drop panel, a fixed panel and a frame assembly;

the frame assembly defines a perimeter of an elevator ceiling;

the frame assembly includes a first rail assembly along a first segment of the perimeter that is substantially parallel to a second rail assembly along a second segment of the perimeter;

the fixed panel is affixed at a first edge to the first rail assembly and at a second edge to the second rail assembly;

the first rail assembly includes a first track along the length of the first rail assembly;

the second rail assembly includes a second track along the length of the second assembly;

the first track and second track are substantially the same length;

the drop panel has a first end of a first slide on a first edge and a first end of a second slide on a second edge;

a second end of the first slide is engaged in the first track and a second end of the second slide is engaged in the second track;

when in a closed mode the drop panel is adjacent to and coplanar to the fixed panel;

when in the closed mode a lock connects the drop panel to the frame assembly such that the drop panel and fixed panel are substantially coplanar;

when the lock disengages the drop panel from the frame assembly the first slide and second slide are allowed to extend vertically thereby lowering the drop panel a predetermined distance into a lowered mode;

when in a lowered mode the second end of the first slide moves in the first track and the second end of the second slide moves in the second track thereby transitioning the drop panel into an open mode;

when the drop panel is fully in the open mode the first slide and second slide are biased to hold the drop panel in the open mode.

2. An elevator ceiling as in claim 1 further characterized in that the first rail assembly includes a third track parallel to the first track and the second rail assembly includes a fourth track parallel to the second track;

a third slider connects the third track to an edge of the drop panel;

a fourth slider connects the fourth track to an edge of the drop panel.

3. An elevator ceiling as in claim 1 further characterized in that an end of the first track has a drop that the second end of the first slide falls into to bias the drop panel in an open mode.

4. An elevator ceiling as in claim 1 further characterized in that both the first slider and the second slider extend to an equal predetermined distance that maintains the drop pane substantially horizontally when the drop panel is in an open mode.

5. An elevator ceiling as in claim 1 further characterized in that in the closed mode the elevator ceiling has a surface area substantially similar to a surface area of an upper side of an elevator cab.

* * * * *